US010723978B2

(12) United States Patent
Saint Victor

(10) Patent No.: US 10,723,978 B2
(45) Date of Patent: Jul. 28, 2020

(54) CLEANING GEL WITH GLYCINE BETAINE ESTER AND NONIONIC SURFACTANT MIXTURE

(71) Applicant: S.C. Johnson & Son, Inc., Racine, WI (US)

(72) Inventor: Marie-Esther Saint Victor, Glencoe, IL (US)

(73) Assignee: S. C. Johnson & Son, Inc., Racine, WI (US)

( * ) Notice: Subject to any disclaimer, the term of this patent is extended or adjusted under 35 U.S.C. 154(b) by 138 days.

(21) Appl. No.: 15/749,442

(22) PCT Filed: Aug. 9, 2016

(86) PCT No.: PCT/US2016/046172

§ 371 (c)(1),
(2) Date: Jan. 31, 2018

(87) PCT Pub. No.: WO2017/034792

PCT Pub. Date: Mar. 2, 2017

(65) Prior Publication Data

US 2018/0223222 A1 Aug. 9, 2018

Related U.S. Application Data

(60) Provisional application No. 62/210,774, filed on Aug. 27, 2015.

(51) Int. Cl.

| | |
|---|---|
| ***C11D 1/62*** | (2006.01) |
| ***C11D 3/37*** | (2006.01) |
| ***C11D 3/22*** | (2006.01) |
| ***C11D 11/00*** | (2006.01) |
| ***C11D 17/00*** | (2006.01) |
| ***C11D 1/835*** | (2006.01) |
| ***C11D 1/66*** | (2006.01) |
| ***C11D 1/722*** | (2006.01) |
| ***C11D 3/18*** | (2006.01) |
| ***C11D 3/20*** | (2006.01) |
| ***C11D 3/30*** | (2006.01) |
| *C11D 1/72* | (2006.01) |

(52) U.S. Cl.

CPC ..... *C11D 3/3707* (2013.01); *C11D 1/62* (2013.01); *C11D 1/662* (2013.01); *C11D 1/722* (2013.01); *C11D 1/835* (2013.01); *C11D 3/18* (2013.01); *C11D 3/2065* (2013.01); *C11D 3/222* (2013.01); *C11D 3/30* (2013.01); *C11D 11/0023* (2013.01); *C11D 17/003* (2013.01); *C11D 17/0056* (2013.01); *C11D 1/72* (2013.01)

(58) Field of Classification Search

CPC ..... C11D 1/62

See application file for complete search history.

(56) References Cited

U.S. PATENT DOCUMENTS

| | | | |
|---|---|---|---|
| 3,578,499 | A | 5/1971 | Crotty et al. |
| 3,681,141 | A | 8/1972 | Muoio |
| 3,955,986 | A | 5/1976 | Miller |
| 4,020,100 | A | 4/1977 | Evans et al. |
| 4,370,272 | A | 1/1983 | Wechsler et al. |
| 4,578,207 | A | 3/1986 | Holdt et al. |
| 4,690,818 | A | 9/1987 | Puchalski et al. |
| 4,911,858 | A | 3/1990 | Bunczk et al. |
| 4,943,612 | A | 7/1990 | Morita et al. |
| 5,047,167 | A | 9/1991 | Steyn et al. |
| 5,213,792 | A | 5/1993 | Grundmann et al. |
| 5,254,290 | A | 10/1993 | Blandizux et al. |
| 5,336,427 | A | 8/1994 | Bunczk et al. |
| 5,429,755 | A | 7/1995 | Ilardi et al. |
| 5,460,742 | A | 10/1995 | Cavanagh et al. |
| 5,466,395 | A | 11/1995 | Tosaka et al. |
| 5,472,629 | A | 12/1995 | Lysy et al. |
| 5,527,477 | A | 6/1996 | Ilardi et al. |
| 5,562,850 | A | 10/1996 | Woo et al. |
| 5,579,842 | A | 12/1996 | Riley |
| 5,591,376 | A | 1/1997 | Kiewert et al. |
| 5,663,138 | A | 9/1997 | Ilardi et al. |

(Continued)

FOREIGN PATENT DOCUMENTS

| | | |
|---|---|---|
| AU | 81384/91 | 11/1991 |
| DE | 35 27 974 A1 | 8/1994 |

(Continued)

OTHER PUBLICATIONS

Abrstact of JP A-6-141797 (1985).

Covis, Rudy et al.: "Interactions and hybrid complex formation of anionic algal polysaccharides with a cationic glycine betaine-derived surfactant", Carbohydrate Polymers, vol. 121, Jan. 8, 2015, pp. 436-448.

Goursaud, Fabrice et al., "Glycine betaine as a renewable raw material to ?greener? new cationic surfactants", Green Chemistry, Royal Society of Chemistry, GB, No. 10, Jan. 1, 2008, pp. 310-320.

International Search Report and Written Opinion on International Application PCT/US2016/049172, dated Nov. 23, 2016, 13 pages.

Matheson et al., "Peaked Distribution Ethoxylates—Their Preparation, Characterization and Performance Evaluation", Journal of American Oil Chemistry Society vol. 63, No. 3, Mar. 1986, pp. 365-370.

(Continued)

*Primary Examiner* — Charles I Boyer

(57) ABSTRACT

Provided are self-adhering cleaning compositions that may include (a) an adhesion promoter, (b) a glycine betaine ester, and (c) water. Commonly, the adhesion promoter may include at least one compound including one or more polyalkoxy groups and the glycine betaine ester may be a compound of formula (I): $Me_3N^+$—$CH_2$—C(O)—O—R $X^-$ (I) wherein R is an aliphatic group having 8 to 22 carbon atoms and X" represents an inorganic or organic anion. Typically, the composition is a gel and may have a gel melt temperature of about 55-80° C., a viscosity at 25° C. of at least about 150,000 cP, and/or a hardness of at least about 150 g. Methods for treating a hard surface, such as a toilet bowl, using the self-adhering cleaning compositions are also provided.

32 Claims, No Drawings

(56) References Cited

U.S. PATENT DOCUMENTS

| | | | | |
|---|---|---|---|---|
| 5,877,135 | A | 3/1999 | Hahn | |
| 5,961,999 | A | 10/1999 | Bimczok et al. | |
| 5,985,808 | A | 11/1999 | He et al. | |
| 6,087,309 | A | 7/2000 | Vinson et al. | |
| 6,333,299 | B1 | 12/2001 | Pace et al. | |
| 6,336,977 | B1 | 1/2002 | Menke et al. | |
| 6,384,266 | B1 | 5/2002 | Farone et al. | |
| 6,407,051 | B1 | 6/2002 | Smith et al. | |
| 6,486,333 | B1 | 11/2002 | Murayama et al. | |
| 6,491,933 | B2 | 12/2002 | Lorenzi et al. | |
| 6,586,639 | B2 | 7/2003 | Murayama et al. | |
| 6,624,126 | B1 | 9/2003 | Kasuga et al. | |
| 6,667,286 | B1 | 12/2003 | Dettinger et al. | |
| 6,914,075 | B2 | 7/2005 | Nakano et al. | |
| 7,018,970 | B2 | 3/2006 | Hsu et al. | |
| 7,022,661 | B2 | 4/2006 | Behler et al. | |
| 7,053,033 | B2 | 5/2006 | Scheper | |
| 7,229,958 | B2 | 6/2007 | Kohle et al. | |
| 7,591,272 | B2 | 9/2009 | Dastbaz et al. | |
| 7,662,225 | B2 | 2/2010 | Antoine et al. | |
| 7,718,595 | B2 | 5/2010 | Murphy et al. | |
| 7,727,948 | B2 * | 6/2010 | Mock-Knoblauch | A61K 8/068 424/486 |
| 7,829,521 | B2 | 11/2010 | Antoine et al. | |
| 7,919,447 | B1 | 4/2011 | Klinkhammer et al. | |
| 7,981,856 | B2 | 7/2011 | Antoine et al. | |
| 8,143,205 | B2 | 3/2012 | Klinkhammer et al. | |
| 8,143,206 | B2 | 3/2012 | Klinkhammer et al. | |
| 8,440,600 | B2 | 5/2013 | Klinkhammer et al. | |
| 8,444,771 | B2 | 5/2013 | Leipold et al. | |
| 8,461,093 | B2 | 6/2013 | Leipold et al. | |
| 8,658,588 | B2 | 2/2014 | Wortley et al. | |
| 8,835,371 | B2 | 9/2014 | Leipold et al. | |
| 8,980,813 | B2 | 3/2015 | Klinkhammer et al. | |
| 8,993,502 | B2 | 3/2015 | Klinkhammer et al. | |
| 9,102,906 | B2 | 8/2015 | Leipold et al. | |
| 9,187,720 | B2 | 11/2015 | Leipold et al. | |
| 9,637,902 | B2 | 5/2017 | Burt et al. | |
| 9,644,359 | B2 | 5/2017 | Burt et al. | |
| 2002/0151446 | A1 | 10/2002 | Piterski et al. | |
| 2003/0083210 | A1 | 5/2003 | Goldberg et al. | |
| 2003/0125220 | A1 | 7/2003 | Dykstra et al. | |
| 2005/0129626 | A1 | 6/2005 | Koivisto et al. | |
| 2005/0215448 | A1 | 9/2005 | Evers et al. | |
| 2006/0111262 | A1 | 5/2006 | Conzelmann et al. | |
| 2006/0204526 | A1 | 9/2006 | Lathrop et al. | |
| 2009/0053323 | A1 | 2/2009 | Tichy et al. | |
| 2009/0215909 | A1 | 8/2009 | Wortley et al. | |
| 2009/0325839 | A1 | 12/2009 | Wortley et al. | |
| 2010/0273694 | A1 * | 10/2010 | Antoine | A61K 8/44 510/124 |
| 2011/0166105 | A1 | 7/2011 | Farng et al. | |
| 2012/0108490 | A1 | 5/2012 | Wortley et al. | |
| 2012/0232170 | A1 | 9/2012 | Klinkhammer et al. | |
| 2013/0178409 | A1 * | 7/2013 | Wortley | C11D 1/66 510/403 |
| 2013/0291764 | A1 | 11/2013 | Mehalebi et al. | |
| 2013/0338227 | A1 * | 12/2013 | Saint Victor | C11D 1/90 514/551 |
| 2014/0037569 | A1 | 2/2014 | Leipold et al. | |
| 2014/0248220 | A1 | 9/2014 | Abram et al. | |
| 2014/0298577 | A1 * | 10/2014 | Burt | A61L 9/048 4/231 |
| 2014/0356311 | A1 | 12/2014 | Leipold et al. | |
| 2015/0159358 | A1 * | 6/2015 | Burt | A61L 9/048 4/231 |
| 2015/0166936 | A1 * | 6/2015 | Klinkhammer | C11D 1/72 510/506 |

FOREIGN PATENT DOCUMENTS

| | | | |
|---|---|---|---|
| EP | 0 192 145 | A2 | 8/1986 |
| EP | 0 631 788 | | 1/1995 |
| EP | 1 978 080 | A1 | 10/2008 |
| GB | 2 280 906 | | 2/1995 |
| GB | 2 288 186 | | 10/1995 |
| WO | WO-96/38528 | | 12/1996 |
| WO | WO-97/05232 | | 2/1997 |
| WO | WO-97/08284 | | 3/1997 |
| WO | WO-97/40133 | | 10/1997 |
| WO | WO-02/26925 | A1 | 4/2002 |
| WO | WO-03/066797 | A1 | 8/2003 |
| WO | WO-2005/121294 | | 12/2005 |
| WO | WO-2009/150369 | A2 | 12/2009 |
| WO | WO-2013/188508 | A1 | 12/2013 |
| WO | WO-2015/091678 | A1 | 6/2015 |

OTHER PUBLICATIONS

Technical Data Sheet for Amphotensid-B4 available at: https://cosmetics.specialchem.com/product/i-zschimmer-schwarz-italiana-amphotensid-b4.

* cited by examiner

CLEANING GEL WITH GLYCINE BETAINE ESTER AND NONIONIC SURFACTANT MIXTURE

BACKGROUND

It would be advantageous to have cleaning compositions, which may self-adhere to a hard surface, such as a toilet bowl or shower. In particular, it may be desirable to have such compositions in the form of a gel, in some instances with a high "hardness" property allowing them to be handled easily by a consumer without significant deformation. It may also be desirable for such gels to have a relatively low gel melt temperature, in order to facilitate processing of the gel composition during manufacturing. Additionally, such compositions may advantageously be transparent, have good foaming properties, and/or be compatible with a wide range of additional ingredients such as fragrance, dyes, surface-modifying polymers, antimicrobial agents, and other cleaning agent auxiliary ingredients.

SUMMARY

The present application relates generally to the field of cleaning compositions and, in particular, cleaning compositions which may be especially useful for cleaning hard surfaces, such as the inside surface of a toilet bowl. The present application provides cleaning compositions, which may commonly self-adhere upon application to a hard surface, typically a vertical or inclined hard surface. The self-adhering cleaning compositions may include (a) an adhesion promoter, (b) a glycine betaine ester, and (c) water. Often, the adhesion promoter includes at least one compound including one or more polyalkoxy groups. The glycine betaine ester may be a compound of formula (I):

$$Me_3N^+—CH_2—C(O)—O—RX^- \quad (I)$$

wherein R is an aliphatic group having 8 to 22 carbon atoms and $X^-$ represents an inorganic or organic anion. Commonly, the composition is a gel. In some embodiments, the gel has a gel melt temperature of about 55-80° C. The gel may have a viscosity at 25° C. of at least about 150,000 cP. In some embodiments, the gel may have a hardness of at least about 150 g.

The adhesion promoter may include at least one compound including one or more polyalkoxy groups. In some embodiments, the adhesion promoter may include an ethoxylated $C_{12}$-$C_{30}$ aliphatic alcohol having an average of about 15 to 100 ethylene oxide units. In some embodiments, the polyalkoxy group may include ethyleneoxide-propyleneoxide block copolymer. In some embodiments, the adhesion promoter may include polyethylene glycol. In some embodiments, the adhesion promoter may include at least one polysaccharide and/or synthetic polymer resin.

The cleaning composition may include other ingredients such as one or more of mineral oil, polyol humectant, an antimicrobial agent, and a fragrance component. Optionally, the composition may include a surfactant selected from nonionic, anionic, cationic, zwitterionic, and/or amphoteric surfactants and mixtures thereof, wherein the surfactant is different from the adhesion promoter.

In another aspect, the present technology provides a composition for treating a hard surface that includes (a) at least one adhesion promoter, which includes at least one polyalkoxy group; (b) a glycine betaine ester of formula (I):

$$Me_3N^+—CH_2—C(O)—O—RX^- \quad (I)$$

wherein R is an aliphatic group having 8 to 22 carbon atoms; and (c) water. The composition is typically a gel, which has a gel melt temperature of about 55-80° C. and a viscosity at 25° C. of at least about 150,000 cP.

In another aspect, the present technology provides a composition for treating a hard surface including (a) at least one adhesion promoter, which includes at least one polyalkoxy group; (b) a glycine betaine ester of formula (I):

$$Me_3N^+—CH_2—C(O)—O—RX^- \quad (I)$$

wherein R is an aliphatic group having 8 to 22 carbon atoms; and (c) water; wherein the composition is a gel having a hardness of at least about 150 g and a gel melt temperature of about 55-80° C.

In some embodiments, it may be advantageous to use a "crude" or "semi-purified" form of the glycine betaine ester. As used herein the term "crude" in reference to the glycine betaine ester is understood to mean the reaction product as formed from the reaction of glycine betaine with an aliphatic alcohol in the presence of an acid (typically methanesulfonic acid), i.e., the final reaction product as is, and used without further treatment or purification. The terms "semi-pure" or "semi-purified" in reference to the glycine betaine ester are understood to mean that the reaction product formed is partly purified, i.e., residual glycine betaine and/or aliphatic alcohol are at least partially removed to provide a mixture which is still not a pure sample of the glycine betaine ester. Such "crude" or "semi-purified" glycine betaine ester components may be especially useful as surfactants in the present cleaning compositions. The "crude" and "semi-purified" glycine betaine ester components employed in the present cleaning compositions typically include at least 50 wt. % and, commonly, at least 60 wt. % of the glycine betaine ester.

In one embodiment, the cleaning compositions may include a mixture of a glycine betaine ester of Formula (I):

$$Me_3N^+—CH_2—C(O)—O—RX^- \quad (I)$$

wherein R is an aliphatic group having 8 to 22 carbon atoms and $X^-$ represents an inorganic or organic anion, and one or more of $Me_3N^+—CH_2—CO_2H\ X^-$ ("a glycine betaine salt"), an aliphatic alcohol ROH, where R is as defined, and an acid HX. Typically, $X^-$ represents an alkanesulphonate anion, such as a methanesulphonate anion and the acid HX is an alkanesulphonic acid, such as a methanesulphonic acid. As used herein, the term "Glycine Betaine" refers to the zwitterionic compound $Me_3N^+—CH_2—CO_2H\ X^-$, where $X^-$ represents a methanesulphonate anion. For example, a "crude" or "semi-purified" glycine betaine amide may include a glycine betaine amide of Formula (I) where R is a lauric group and one of more of methanesulphonic acid, lauric amine ($RNH_2$ where R is a lauric group) and a methanesulphonate salt of lauric amine.

In one aspect, a method for treating a hard surface using the self-adhering cleaning compositions described herein is also provided. The method includes applying a dose of the composition directly on the hard surface to be treated. When water is passed over the self-adhering composition and the hard surface, a portion of the self-adhering composition may be released into the water that flows over the dose. The portion of the self-adhering composition that is released into the flowing water may provide a wet film on at least a portion of the hard surface. For example, the method may be used to treat the inside of a toilet bowl. A dose of the self-adhering composition may be applied directly on an inside surface of the toilet bowl.

Further, one of skill in the art will appreciate that, when used in conjunction with a metered dispenser, the dispenser may provide doses of the composition in any volume and/or size that is suitable for the intended application. Similarly, the shape of the dispenser may be any shape that is desired. For example, in an exemplary embodiment, a dispenser used to dispense the present gel composition may include a cylindrical body with the gel contained therein. Such a dispenser may include a guide member to push the gel composition through a dispenser mouth, which may be in any shape that is desirable for the intended purpose. Non-limiting examples of cross-sectional shapes may be selected from: squares, circles, triangles, ovals, stars, ring-shaped, and the like.

DETAILED DESCRIPTION

In use, some of the compositions of the present technology may be applied directly on the hard surface to be treated, e.g. cleaned, such as a toilet bowl, shower or bath enclosure, drain, window, or the like, and self-adheres thereto, commonly through a plurality of flows of water passing over the self-adhering composition and surface, e.g. flushes, showers, rinses or the like. Each time water flows over the composition, a portion of the composition is released into the water that flows over the composition. The portion of the composition released onto the water covered surface provides a continuous wet film to the surface to in turn provide for immediate and long term cleaning and/or disinfecting and/or fragrancing or other surface treatment depending on the active agent(s) present in the composition. It is thought that the composition, and thus the active agents of the composition, may spread out from or are delivered from the initial composition placement in direct contact with the surface to coat continuously an extended area on the surface. Typically, the wet film acts as a coating and emanates from the self-adhering composition in all directions, i.e., 360 degrees, from the composition, which includes in a direction against the flow of the rinse water. Motions of the surface of a liquid are coupled with those of the subsurface fluid or fluids, so that movements of the liquid may produce stresses in the surface and vice versa. The composition may be especially useful in treating the surface of a toilet bowl since it allows for delivery and retention of a desired active agent on a surface above the water line in the bowl as well as below the water line.

In one aspect, the composition may be a composition for treating a hard surface that includes (a) an adhesion promoter, which comprises at least one compound including one or more polyalkoxy groups; (b) a glycine betaine ester of formula (I):

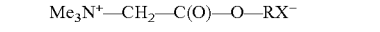

$$Me_3N^+—CH_2—C(O)—O—RX^- \quad (I)$$

wherein R is an aliphatic group having 8 to 22 carbon atoms; and $X^-$ represents an inorganic or organic anion; and (c) water; wherein the composition is self-adhering upon application to a hard surface. In some embodiments, the composition may include at least about 25 wt. % water or more preferably at least about 40 wt. % water.

Glycine betaine is a natural and inexpensive material derived from sugar beet molasses. The present glycine betaine esters may be derived from natural glycine betaine, providing a green (eco-friendly) and multifunctional material. Particularly of use is a glycine betaine ester of formula (I), wherein R may be an aliphatic group having 8 to 22 carbon atoms and $X^-$ represents an inorganic or organic anion. Natural glycine betaine typically includes a methanesulfonate anion as the counterion, $X^-$. The glycine betaine ester component of the present compositions may include one or more glycine betaine esters of formula (I). In some embodiments, R may be a linear or branched aliphatic group. In some embodiments, R may be a linear aliphatic group. In some embodiments, R may be an alkyl or an alkenyl group. In some embodiments, R may be an aliphatic group having 10 to 18 carbon atoms. In some embodiments, R may be a linear primary aliphatic group having 8 to 18 carbon atoms, e.g. an R group that is part of a fatty alcohol compound. In another embodiment, R may be an aliphatic group having 10 to 16 carbon atoms, such as the R group present in a $C_{10}$-$C_{16}$ linear primary alkyl alcohol. The R group may be a $C_8$, $C_{10}$, $C_{12}$, $C_{14}$, $C_{16}$, and/or $C_{18}$ aliphatic group, e.g., a $C_8$, $C_{10}$, $C_{12}$, $C_{14}$, $C_{16}$, and/or $C_{18}$ linear primary alkyl and/or alkenyl group. In some embodiments, R may be a $C_{10}$, $C_{12}$, $C_{14}$, and/or $C_{16}$ aliphatic group. In some embodiments, R may be a lauric, mystric, palmitic, stearic, and/or oleic group. In certain embodiments, R may include a lauric and/or mystric group. In some embodiments, R may be a $C_{12}$ and/or $C_{14}$ alkyl and/or alkenyl group. Examples of suitable inorganic or organic anions which may be present as the counterion, $X^-$, include halide, carboxylic acid, alkylcarbonate, alkylsulfonate, arylsulfonate, alkylsulfate, sulfate, nitrate, phosphate, and phosphite anions. In some embodiments, $X^-$ represents $Cl^-$, $Br^-$, $I^-$, $CH_3CO_2^-$, $CH_3CH(OH)CO_2^-$, $CH_3SO_3^-$, $ArSO_3^-$, $CH_3C_6H_4SO_3^-$, $CH_3OSO_3^-$, $H_2PO_4^-$, and/or $H_2PO_3^-$ anion. $X^-$ may be a halide or alkylsulfonate anion. In some embodiments, $X^-$ may be a chloride or methanesulfonate anion. As noted above, in glycine betaine esters derived from natural glycine betaine, $X^-$ may commonly be a methane sulfonate anion.

In many embodiments of the present compositions, the glycine betaine ester may be present in combination with an aliphatic alcohol (i.e., ROH), wherein R is as defined above, and/or glycine betaine and/or salt thereof. Often, aliphatic alcohol may be present as an unreacted starting material of the reaction used to produce the glycine betaine ester. In such cases, the "R group" of the aliphatic alcohol is commonly the same as the "R group" of the glycine betaine ester. The weight ratio of the glycine betaine ester to the aliphatic alcohol in the compositions may be about 20:1 to 1:5, more commonly about 10:1 to 2:1. In some embodiments, the weight ratio of the glycine betaine ester to the aliphatic alcohol may be about 10:1 to 1:2 or about 5:1 to 1:2. In some embodiments, the glycine betaine ester may include a mixture of glycine betaine esters having R groups with 12 to 14 carbon atoms. The composition may also include one or more fatty alcohols with 12 to 14 carbon atoms and/or salt thereof in combination with such a glycine betaine ester. In some embodiments, the glycine betaine ester component may be an unpurified reaction product, which also includes glycine betaine and/or salt thereof. In some embodiments, such an unpurified reaction product may include methanesulfonic acid and/or salt thereof. In addition to the glycine betaine ester, in some embodiments the composition may further include an aliphatic amine, e.g. aliphatic $C_8$-$C_{22}$ amine, more typically a $C_8$-$C_{15}$ amine such as a $C_8$-$C_{14}$ fatty amine. For example, the composition may include a linear aliphatic $C_8$-$C_{18}$ amine in combination with the glycine betaine ester. In some embodiments, the composition may include a glycine betaine ester of Formula I, wherein the $X^-$ represents a methanesulfonate anion and the R group comprises a lauric and/or myristic group. In some embodiments, the composition may include about 0.1 wt. % to about 10 wt. % of the glycine betaine ester or more preferably about 0.1 wt. % to about 5 wt. % of the glycine betaine ester.

In some embodiments, in addition to the glycine betaine ester, the composition may also include a glycine betaine amide, e.g. a glycine betaine amide of formula (II):

$$X^{-}Me_3N^{+}—CH_2—C(O)—NH—R \quad (II),$$

wherein R and $X^{-}$ are as defined above.

In some embodiments, the composition may be a gel with a hardness about ≥150 g. In some embodiments, the gel hardness may be at least about 175 g or more preferably at least about 200 g. The compositions may have a gel hardness of at least about 175 g or at least about 185 g. In some embodiments, the gel hardness may range from about 150 g to 300 g. The gel hardness may range from about 175 g to 275 g or more preferably from about 185 g to 250 g. In one embodiment, the gel melt temperature may be at least about 40° C., at least about 50° C., or at least about 60° C. The gel melt temperature may range from about 55° C. to 80° C., from about 55° C. to 75° C., or more desirably from about 60° C. to 70° C. In another embodiment, the gel melt temperature may be no more than about 80° C., no more than about 75° C., or no more than about 70° C. In some embodiments, the cleaning composition may be a gel and have viscosity at 25° C. of at least about 150,000 centipoise (cP). In another embodiment, the gel may have a viscosity at 25° C. of about 200,000 to 1,100,000 cP, or about 250,000 to 800,000 cP. The composition may be a gel having a gel melt temperature of about 60-70° C., and a viscosity at 25° C. of about 300,000 to 600,000 cP.

The adhesion promoter may include at least one compound including one or more polyalkoxy groups. In some embodiments, the composition may include about 15 wt. % to 40 wt. % of the adhesion promoter or more preferably about 15 wt. % to 35 wt. %. In some embodiments, the adhesion promoter may include an ethoxylated $C_{12}$-$C_{30}$ aliphatic alcohol having an average of about 15 to 100 ethylene oxide units. In some embodiments, the adhesion promoter may include an ethoxylated linear $C_{14}$-$C_{22}$ primary aliphatic alcohol having an average of about 15 to 40 ethylene oxide units. In some embodiments, the composition may include about 15 to 40 wt. % of an ethoxylated $C_{12}$-$C_{30}$ aliphatic alcohol having an average of about 15 to 100 ethylene oxide units or more preferably about 20 wt. % to about 35 wt. %. The composition may include about 20-35 wt. % of an ethoxylated $C_{14}$-$C_{22}$ fatty alcohol having an average of about 20-35 ethylene oxide unit.

In some embodiments, the adhesion promoter may include ethyleneoxide-propyleneoxide block copolymer. The ethylene oxide-propylene oxide block copolymer may include an EO-PO block copolymer, an EO-PO-EO block copolymer, a $C_8$-$C_{18}$ alcohol EO-PO adduct, a $C_8$-$C_{18}$ alcohol PO-EO adduct, and/or an EO-PO dialkyl ether. The total molecular weight of such ethylene oxide-propylene oxide block copolymers is typically in the range of about 2,000 to 8,000. In some embodiments, the composition may include up to about 20 wt. % or more preferably about 1 to 10 wt. % of the ethyleneoxide-propyleneoxide block copolymer.

In some embodiments, the adhesion promoter may further include one or more of a polysaccharide, polysaccharide derivative, and/or synthetic polymer resin. Nonlimiting examples include cellulose, sodium carboxymethyl cellulose, hydroxyethyl cellulose, hydroxypropyl cellulose, carob bean flour, and starch. In some embodiments, the adhesion promoter may further include a protein such as gelatin. In some embodiments, the composition may include about 0.1 wt. % to 5 wt. %, or more desirably about 0.1 wt. % to 3 wt. % of one or more of a polysaccharide, polysaccharide derivative, and/or synthetic polymer resin.

In some embodiments, the adhesion promoter may include polyethylene glycol. In some embodiments, the composition may include about 0.5 to 5 wt. % polyethylene glycol, about 1 to 5 wt. % polyethylene glycol, or more preferably about 1 to 3 wt. % polyethylene glycol. In some embodiments, the adhesion promoter may include a polywax.

In some embodiments, in addition to a polyalkoxy-based adhesion promoter the present gel compositions may also include an additive(s) which can function as a thickening and/or co-hardening agent. Suitable examples of such additives include agent(s) having very low solubility in water, typically soluble in water at less than about 0.1% by weight. Such additives may desirably have a low vapor pressure and include a high flash point hydrocarbon or hydrocarbon mixtures, such as mineral oil, naphthenic oil, or paraffin oil and/or polysiloxane, such as a silicone oil. Other suitable agents include low vapor pressure, high flash point oxygenated hydrocarbons having very low water solubility, such as esters, fatty or synthetic alcohols, or $C_{10}$-$C_{18}$ alcohol ethoxylates with an average degree of ethoxylation of no more than about 2 and often about 1 mole of ethylene oxide per mole of alcohol. Examples of oxygenated hydrocarbons, suitable as co-hardening agents include alkyl esters of $C_{10}$-$C_{22}$ fatty acids, such as isopropyl myristate, $C_{10}$-$C_{16}$ aliphatic alcohols, and $C_{10}$-$C_{16}$ alcohol aliphatic alcohol ethoxylates with no more than about 2 mole average degree of ethoxylation, often with no more than about 1 mole average degree of ethoxylation, and typically mono-ethoxylates, such as the mono-ethoxylate of lauryl alcohol. The gel compositions may include about 0.1 to 10 wt. %, commonly about 0.5 to 5 wt. % of the such agent(s). In many instances, the gel composition includes about 0.5 to 3% of the co-hardening agent(s). The flash point of the co-hardening agent is generally about 90° C. or higher.

The present composition may optionally include a surfactant selected from nonionic, anionic, cationic, zwitterionic and/or amphoteric surfactants and mixtures thereof; wherein the surfactant is different from the adhesion promoter. In some embodiments, the composition may include up to about 20 wt. %, about 0.1 wt. % to 15 wt. %, about 0.5 to 10 wt. %, about 1 to about 5 wt. %, or about 10 to 20 wt. % of the surfactant. The surfactants may include one or more alkoxylated alcohols that are different from the adhesion promoter. The alkoxylated alcohol may include one or more ethoxylated alcohols. The ethoxylated alcohol may be linear or branched. In some embodiments, the ethoxylated alcohol may include a $C_8$-$C_{16}$ alcohol having an average of 5 to 15 ethylene oxide units, more commonly 5 to 12 ethylene oxide units. Typically, when present, the ethoxylated alcohol includes a $C_9$-$C_{15}$ linear and/or branched alcohol having an average of 5 to 12 ethylene oxide units. A non-limiting example is Genapol® X-100 (available from CLARIANT), which is a branched iso-$C_{13}$ alcohol ethoxylate having an average of 10 ethylene oxide units.

Other ethoxylated alcohols that may be present in the present cleaning compositions as a nonionic surfactant include linear or branched ethoxylated alcohols including a $C_5$-$C_{15}$ alcohol having an average of 4 to 12 ethylene oxide units. Nonlimiting examples include Tomadol® 91-6—a $C_9$-$C_{11}$ ethoxylated alcohol having an average of 6 ethylene oxide units (available from Air Products and Chemicals, Inc.), LUTENSOL® AO-8—a synthetic $C_{13}$-$C_{15}$ ethoxylated oxo alcohol having an average of 8 ethylene oxide units (available from BASF), Genapol® LA 070S—an ethoxylated lauryl alcohol having an average of 7 ethylene oxide units (available from CLARIANT), and TERGI- TOL™ 15-S-7, a branched secondary ethoxylated alcohol with 7 ethylene oxide units (available from DOW Chemical). Other examples of suitable ethoxylated linear alcohols include ethoxylated linear alcohols having a $C_{10}$-$C_{15}$ n-alkyl group, e.g., having an average of 5 to 12 ethylene oxide units. Nonlimiting examples include LUTENSOL® TDA 10 (available from BASF)—an ethoxylated tridecyl alcohol having an average of 10 EO groups.

Other nonionic surfactants which may be present include, but are not limited to, secondary ethoxylated alcohols, such as $C_{11}$-$C_{15}$ secondary ethoxylated alcohols. Secondary ethoxylated alcohols suitable for use are sold under the tradename TERGITOL® (available from Dow Chemical). For example TERGITOL® 15-S, more particularly TERGITOL® 15-S-12 is a $C_{11}$-$C_{15}$ secondary ethoxylate alcohol having an average of about 12 ethylene oxide groups.

Other exemplary useful nonionic surfactants include a variety of known nonionic surfactant compounds. Practically any hydrophobic compound having a carboxy, hydroxy, amido, or amino group with a free hydrogen attached to the nitrogen can be condensed with ethylene oxide or with the polyhydration product thereof, polyethylene glycol, to form a nonionic surfactant compound with varying degrees of water solubility—depending on the relative length of the hydrophobic and hydrophilic polyethylenoxy elements. Exemplary nonionic compounds include the polyoxyethylene ethers of alkyl aromatic hydroxy compounds, e.g., alkylated polyoxyethylene phenols, polyoxyethylene ethers of long chain aliphatic alcohols (e.g., ethoxylated alcohols), the polyoxyethylene ethers of hydrophobic propylene oxide polymers, and the higher alkyl amine oxides.

Further nonionic surfactants which may be optionally present in the compositions are alkyl polyglycosides (e.g. Glucopon® 425N). Suitable alkyl polyglycosides include known nonionic surfactants which are alkaline and electrolyte stable. Alkyl mono and polyglycosides are generally prepared by reacting a monosaccharide, or a compound hydrolyzable to a monosaccharide with an alcohol such as a fatty alcohol in an acid medium. The fatty alcohol may have from about 8 to 30 and typically 8 to 18 carbon atoms. Examples of such alkylglycosides include, APG 325 CS GLYCOSIDE which is reported to be a 50% $C_9$-$C_{11}$ alkyl polyglycoside (commercially available from Henkel Corp, Ambler Pa.) and GLUCOPON® 625 CS which is reported to be a 50% $C_{10}$-$C_{16}$ alkyl polyglycoside. In some embodiments, the nonionic surfactant may include an alkylpolyglycoside and/or an ethoxylated $C_8$-$C_{15}$ alcohol having an average of 5 to 12 ethylene oxide units.

Alkylpolyglycosides suitable for use in the present compositions may have the formula:

$$RO—(R'O)_x—Z_n$$

where R is a monovalent aliphatic radical containing 8 to 20 carbon atoms (the aliphatic group may be straight or branched, saturated or unsaturated), R' is a divalent alkyl radical containing 2 to 4 carbon atoms, preferably ethylene or propylene, x is a number having an average value of 0 to about 12, Z is a reducing saccharide moiety containing 5 or 6 carbon atoms, such as a glucose, galactose, glucosyl, or galactosyl residue, and n is a number having an average value of about 1 to 10. Some exemplary alkyl polyglycosides are sold under the name GLUCOPON® (where Z is a glucose moiety and x=0).

Additional suitable nonionic surfactants include linear alkyl amine oxides. Typical linear alkyl amine oxides include water-soluble amine oxides of the formula $R^1$—N$(R^2)(R^3)$O where $R^1$ is typically a $C_8$-$C_{18}$ alkyl moiety and the $R^2$ and $R^3$ moieties are typically selected from the group consisting of hydrogen, $C_1$-$C_3$ alkyl groups, and $C_1$-$C_3$ hydroxyalkyl groups. Quite often, $R^1$ is a $C_8$-$C_{18}$ n-alkyl and $R^2$ and $R^3$ are methyl, ethyl, propyl, isopropyl, 2-hydroxyethyl, 2-hydroxypropyl, and/or 3-hydroxypropyl. The linear amine oxide surfactants in particular may include linear $C_{10}$-$C_{18}$ alkyl dimethyl amine oxides and linear $C_8$-$C_{12}$ alkoxy ethyl di(hydroxyethyl) amine oxides. Particularly suitable amine oxides include linear $C_{10}$, linear $C_{10}$-$C_{12}$, and linear $C_{12}$-$C_{14}$ alkyl dimethyl amine oxides. Other examples of amine oxide nonionic surfactants include alkyl amidopropyl amine oxides, such as lauryl/myristyl amidopropyl amine oxides (e.g., lauryl/myristyl amidopropyl dimethylamine oxide).

Additional suitable nonionic surfactants include polyethoxylated fatty esters. These include, for example, polyethoxylated sorbitan monooleate, sorbitan monolaurate, sorbitan monopalmitate and/or sorbitan monostearate, and polyethoxylated castor oil. Specific examples of such surfactants are the products of condensation of ethylene oxide (e.g., 10-25 moles) with sorbitan monooleate and condensation of ethylene oxide (e.g., 20-40 moles) with castor oil.

The composition may further include one or more of mineral oil, polyol humectant, and adjuvants. In some embodiments, the composition may further include one or more of mineral oil, polyol humectant, an antimicrobial agent, and a fragrance component. In some embodiments, the composition may include up to about 10 wt. %, about 0.1 to 5 wt. %, or about 0.2 to 3 wt. % mineral oil and/or other co-hardening agent.

Examples of suitable polyol humectants include glycerin, glycols, such as ethylene glycol, propylene glycol, diethylene glycol, dipropylene glycol, butylene glycol and the like, sugar alcohols such as sorbitol, xylitol, and maltitol, sugars such as glucose, galactose, or compounds with glucosyl or galactosyl residues, and mixtures thereof. In some embodiments, the composition may include 0 wt. % to about 20 wt. % of a polyol humectant or more preferably about 1 wt. % to 10 wt. %. In some embodiments, the composition may include about 1 wt. % to 10 wt. % or about 1 wt. % to 5 wt. % glycerin.

As used herein, adjuvants include components or agents, such as additional functional materials. In some embodiments, the functional materials may be included to provide desired properties and functionalities to the cleaning composition. For the purpose of this application, the term "functional materials" include a material that when dispersed or dissolved in a concentrate and/or use solution, such as an aqueous solution, provides a beneficial property in a particular use. The present compositions may optionally include other soil-digesting components, surfactants, disinfectants, detergent fillers, sanitizers, acidulants, complexing agents, biocides and/or antimicrobial agents, corrosion inhibitors, anti-redeposition agents, foam inhibitors, opacifying agents such as titanium dioxide, dyes, bleaching agents (hydrogen peroxide and other peroxides), enzymes, enzyme stabilizing systems, builders, thickening or gelling agents, wetting agents, dispersants, stabilizing agents, dispersant polymers, cleaning compounds, pH adjusting agents (acids and alkaline agents), stain preventers, and/or fragrances. In some embodiments, the composition may include 0 wt. % to about 10 wt. %, 1 wt. % to about 10 wt. %, or 0.1 wt. % to about 5 wt. % of a fragrance component.

In some embodiments, the composition may include an ethoxylated alcohol, glycine betaine ester, a polymeric alkylene oxide block copolymer, mineral oil, and water. The cleaning composition may optionally include a polyol humectant, such as glycerin, sorbitol and/or other sugar alcohol. In some embodiments, the composition is a gel having a hardness of at least about 150 g and/or a gel melt temperature of about 50-80° C. Often the cleaning compositions may include a fragrance component.

In certain aspects, the present cleaning compositions may include adhesion promoter, such as an alkoxylated alcohol, the glycine betaine ester, polyol humectant, mineral oil, polyethyleneglycol and water. The aqueous-based composition may also include an anionic surfactant (such as a ethoxylated fatty alcohol sulfate and/or sulfonate ester), fragrance and/or a $C_{10}$-$C_{15}$ fatty alcohol. For example, cleaning composition may include ethoxylated alcohol, the glycine betaine ester, anionic sulfate ester (such as sodium laureth sulfate), glycerin, mineral oil, polyethyleneglycol and water. In an exemplary embodiment, the composition is an aqueous-based gel, which includes about 20-35 wt. % of an ethoxylated $C_{14}$-$C_{22}$ fatty alcohol having an average of 15 to 40 ethylene oxide units; about 0.1-5 wt. % of the glycine betaine ester; about 2-10 wt. % glycerin; about 0.5-5 wt. % polyethyleneglycol; about 0.5-3 wt. % mineral oil; and at least about 40 wt. % water. Such aqueous-based compositions may also include about 1-10 wt. % of a fragrance component. These compositions may also include about 0.5 to 5 wt. % of an amine compound as a basic agent. In some embodiments, the compositions may also include about 0.05-0.5 wt. % of an inorganic basic material, such as sodium hydroxide.

In certain aspects, the present cleaning compositions may include adhesion promoter, such as an alkoxylated fatty alcohol, the glycine betaine ester, polyol humectant, a film forming polymer additive (e.g., hydrophilic polyacrylate copolymer), ethoxylated $C_{10}$-$C_{15}$ alcohol nonionic surfactant, and water. The aqueous-based composition may also include fragrance, polyethyleneglycol and/or mineral oil. For example, cleaning composition may include ethoxylated alcohol (e.g., an ethoxylated $C_{14}$-$C_{22}$ fatty alcohol having an average of 15 to 40 ethylene oxide units), the glycine betaine ester, glycerin, an ethoxylated $C_{10}$-$C_{15}$ alcohol having an average of 2 to 5 ethylene oxide units, an amphoteric polyacrylate copolymer containing pendent quaternary ammonium groups (e.g., MIRAPOL SURF S available from Rhodia), and water. In an exemplary embodiment, the composition is a gel, which includes about 20-35 wt. % of an ethoxylated $C_{14}$-$C_{22}$ fatty alcohol having an average of 15 to 40 ethylene oxide units; about 0.1-5 wt. % of the glycine betaine ester; about 1-5 wt. % of the ethoxylated $C_{10}$-$C_{15}$ alcohol; about 2-10 wt. % glycerin; about 0.5-2 wt. % of the amphoteric polyacrylate copolymer and at least about 40 wt. % water. Such compositions may also include about 1-10 wt. % of a fragrance component, about 0.5-5 wt. % polyethyleneglycol and/or about 0.5-3 wt. % mineral oil. These compositions may also include about 0.5 to 5 wt. % of an amine compound as a basic agent. In some embodiments, the compositions may also include about 0.05-0.5 wt. % of an inorganic basic material, such as sodium hydroxide, as the basic agent.

In certain aspects, the present cleaning compositions may include adhesion promoter, such as an alkoxylated fatty alcohol, the glycine betaine ester, polyol humectant, mineral oil, cationic surfactant, and water. Such aqueous-based compositions may also include a fragrance component and/or other additives. For example, cleaning composition may include ethoxylated alcohol (e.g., an ethoxylated $C_{14}$-$C_{22}$ fatty alcohol having an average of 15 to 40 ethylene oxide units), the glycine betaine ester, glycerin, mineral oil, a cationic surfactant such as an alkylpolyglucoside derivative having pendent quaternary ammonium groups, and water. In an exemplary embodiment, the aqueous-based composition is a gel (in the absence of the propellant) which includes about 20-35 wt. % of an ethoxylated $C_{14}$-$C_{22}$ fatty alcohol having an average of 15 to 40 ethylene oxide units; about 0.5-3 wt. % mineral oil; about 2-10 wt. % glycerin; about 0.1-5 wt. % of the glycine betaine ester; about 1-5 wt. % of the alkylpolyglucoside derivative; and at least about 40 wt. % water. Such aqueous-based compositions may also include about 1-10 wt. % of a fragrance component. These compositions may also include about 0.5 to 5 wt. % of an amine compound as a basic agent. In some embodiments, the compositions may include about 0.05-0.5 wt. % of an inorganic basic material, such as sodium hydroxide, as the basic agent.

In certain aspects, the present cleaning compositions may include adhesion promoter, such as an alkoxylated fatty alcohol, the glycine betaine ester, an anionic surfactant (such as a ethoxylated fatty alcohol sulfate and/or sulfonate ester), polyol humectant, mineral oil, hydrophilic polyacrylate copolymer, and water. The aqueous-based composition may also include a fragrance component. For example, cleaning composition may include an ethoxylated alcohol (e.g., an ethoxylated $C_{14}$-$C_{22}$ fatty alcohol having an average of 15 to 40 ethylene oxide units), the glycine betaine ester, glycerin, mineral oil, an amphoteric polyacrylate copolymer containing pendent quaternary ammonium groups (e.g., MIRAPOL SURF S available from Rhodia), and water. Such compositions may also include an anionic sulfate ester (such as sodium laureth sulfate). In an exemplary embodiment, the aqueous-based composition is a gel (in the absence of the propellant) which includes about 20-35 wt. % of an ethoxylated $C_{14}$-$C_{22}$ fatty alcohol having an average of 15 to 40 ethylene oxide units; about 0.1-5 wt. % of the glycine betaine ester; about 0.1-3 wt. % of the amphoteric polyacrylate copolymer; about 2-10 wt. % glycerin; about 1-3 wt. % mineral oil; and at least about 40 wt. % water. Such aqueous-based compositions may also include about 1-10 wt. % of a fragrance component. These compositions may also include about 0.5 to 5 wt. % of an amine compound as a basic agent. In some embodiments, the compositions may include about 0.05-0.5 wt. % of an inorganic basic material, such as sodium hydroxide, as the basic agent.

In certain aspects, the cleaning compositions include an alkoxylated alcohol (e.g., ethoxylated alcohol), polymeric alkyleneoxide block copolymer (e.g., a ethyleneoxide-propyleneoxide block copolymer), the glycine betaine ester, mineral oil, and water. In some embodiments, the cleaning compositions may include one or more additional components, such as a natural or synthetic polymer resin, a polyol humectant (such as glycerin, sorbitol, and/or other sugar alcohol), and/or an anionic and/or amphoteric surfactant and/or nonionic surfactant which is not an alkoxylated alcohol. Optionally, the cleaning compositions may also include one or more adjuvants, such as a fragrance, a complexing agent, and/or a bleaching agent. The alkoxylated alcohol component may include a mixture of ethoxylated alcohols having varying degrees of ethoxylation. For example, the ethoxylated alcohol component may include an ethoxylated $C_{14}$-$C_{30}$ alcohol having an average of about 20 to 50 ethylene oxide units and an ethoxylated $C_8$-$C_{15}$ alcohol having an average of about 5 to 15 ethylene oxide units. In some embodiments, such compositions may be a gel having a hardness of at least about 150 g and/or a gel melt temperature of about 50-80° C.

In another aspect, the cleaning composition may be an adhesive cleaning composition in which the adhesion promoter includes a ethoxylated alcohol, e.g., an ethoxylated $C_{12}$-$C_{30}$ alcohol having an average of 15 to 50 ethylene oxide units, ethyleneoxide-propyleneoxide block copolymer, the glycine betaine ester, mineral oil, and water. In some embodiments, the cleaning composition may include about 15-40 wt. % of a first ethoxylated alcohol, which is an ethoxylated $C_{14}$-$C_{30}$ alcohol having an average of 20 to 50 ethylene oxide units; about 1-15 wt. % ethyleneoxide-propyleneoxide block copolymer; about 0.5-10 wt. % mineral oil; about 0.1-5 wt. % of the glycine betaine ester; and water. These compositions may also include about 0.5 to 5 wt. % of an amine compound as a basic agent. In some embodiments, the compositions may include about 0.05-0.5 wt. % of an inorganic basic material, such as sodium hydroxide, as the basic agent. The cleaning composition may often also include an ethoxylated $C_8$-$C_{15}$ alcohol having an average of about 5 to 15 ethylene oxide units.

In some embodiments, the present adhesive cleaning composition may include (a) about 0.1-5 wt. % of the glycine betaine ester; (b) about 15-40 wt. % of the adhesion promoter; (c) about 0.1-5 wt. % polyethylene glycol; (d) about 1-10 wt. % polyol humectant; (e) about 1-10 wt. % of a fragrance component; and (f) at least about 25 wt. % water. In some embodiments, the composition may include (a) about 15-35 wt. % of the adhesion promoter, which includes an ethoxylated $C_{14}$-$C_{22}$ fatty alcohol having an average of about 15-40 ethylene oxide units; (b) about 0.1-5 wt. % of the glycine betaine ester; (c) about 1-10 wt. % ethyleneoxide-propyleneoxide block copolymer; (d) about 1-10 wt. % glycerin; (e) about 0.1-3 wt. % mineral oil; (f) 0 to about 10 wt. % of a fragrance component; and (g) at least about 40 wt. % water. The composition may include (a) about 15-35 wt. % of the adhesion promoter, which includes an ethoxylated $C_{14}$-$C_{22}$ fatty alcohol having an average of about 15-40 ethylene oxide units; (b) about 0.1-5 wt. % of the glycine betaine ester; (c) about 0.5-5 wt. % of one or more ethoxylated linear primary alcohols, wherein each alcohol includes a carbon chain containing 9 to 15 carbons and from 2 to 12 ethylene oxide units; (d) about 1-10 wt. % glycerin; (e) 0 to about 3 wt. % mineral oil; (f) 0 to about 5 wt. % polyethylene glycol; (g) 0 to about 10 wt. % of a fragrance component; and (h) at least about 40 wt. % water. In some embodiments, the composition may include (a) about 15-35 wt. % of the adhesion promoter, which includes an ethoxylated $C_{14}$-$C_{22}$ fatty alcohol having an average of about 15-40 ethylene oxide units; (b) about 0.1-5 wt. % of the glycine betaine ester; (c) about 0.1-3 wt. % mineral oil; (d) about 1-10 wt. % glycerin; (e) about 0.1-5 wt. % polyethylene glycol; (f) 0 to about 3 wt. % of one or more linear primary alcohols, wherein each alcohol includes a carbon chain containing 9 to 15 carbons; (g) 0 to about 10 wt. % of a fragrance component; and (h) at least about 40 wt. % water.

In another aspect, the cleaning composition may be an adhesive cleaning composition that includes a ethoxylated alcohol, which may be an ethoxylated $C_{10}$-$C_{30}$ alcohol having an average of 8 to 50 ethylene oxide units and commonly about 15 to 40 ethylene oxide units; glycine betaine ester; ethyleneoxide-propyleneoxide block copolymer; mineral oil; and water. The composition may be self-adhering upon application to a hard surface.

In some embodiments, the cleaning composition may be an adhesive cleaning composition that includes about 15-40 wt. % of a first ethoxylated alcohol, which is an ethoxylated $C_{14}$-$C_{30}$ alcohol having an average of 20 to 50 ethylene oxide units; about 0.1-5 wt. % glycine betaine ester; about 1-15 wt. % ethyleneoxide-propyleneoxide block copolymer; about 0.5-10 wt. % mineral oil; and water. The cleaning composition may commonly also include an ethoxylated $C_8$-$C_{15}$ alcohol having an average of about 5 to 15 ethylene oxide units.

In another aspect, the present technology provides a composition for treating a hard surface that includes (a) at least one adhesion promoter, which includes at least one polyalkoxy group; (b) a glycine betaine ester of Formula I, wherein R is an aliphatic group having 8 to 22 carbon atoms; and (c) water; wherein the composition is a gel having has a gel melt temperature of about 55-80° C. and a viscosity at 25° C. of at least about 150,000 cP.

In another aspect, the present technology provides a composition for treating a hard surface that includes (a) at least one adhesion promoter, which includes at least one polyalkoxy group; (b) a glycine betaine ester of Formula I, wherein R is an aliphatic group having 8 to 22 carbon atoms; and (c) water; wherein the composition is a gel having a hardness of at least about 150 g and a gel melt temperature of about 55-80° C.

In some embodiments, the adhesion promoter may further include a hydrophilic polymer. In some embodiments, the composition may further include an active agent, wherein the active agent is one or more of a fragrance, germicide, antimicrobial, bleach, or deodorizer.

In some embodiments, the composition may be applied directly to a surface using any suitable applicator device, such as a pump or syringe-type device, manual, pressurized, or mechanized, aerosol, or sprayer. The consumer may activate the applicator for application of the composition directly to a surface without the need to touch the surface. In the case of a toilet bowl surface, this provides for a hygienic and easily accessible method of application. The amount and location(s) of the composition may be chosen by the user, e.g. one or more dollops or drops of composition, or one or more lines of composition. The composition may self-adhere to the hard surface to which it is applied, such as the ceramic side wall of a toilet bowl or shower wall. A surprising and unique feature not provided by conventional devices is that the composition may be delivered to surfaces located above the site of application of the composition.

Known applicators for gel-like substances may be used with the present compositions. For example, PCT Int. Pat. App. WO 03/043906 and WO 2004/043825 disclose exemplary dispensing devices. However, some users may find that the inability to provide consistent dosing associated with known applicators frustrating. A non-limiting exemplary dispenser that is capable of providing metered doses of a composition that may be compatible with the present compositions is described in U.S. Pat. App. No. 2007/0007302A1. When used in conjunction with a metered dispenser, the dispenser may provide doses of the composition in any volume and/or size and/or dose that is suitable for the intended application. Similarly, the shape of the dispenser may be any shape that is desired.

In one embodiment, a composition according to the present technology may be provided in a dispenser wherein the dispenser provides unitized doses. In a particular embodiment, the unitized dose may be from about 4 g/dose to about 10 g/dose. In another embodiment, the unitized dose may be from about 5 g/dose to about 9 g/dose. In yet another embodiment, the dispenser may provide from about 6 to about 8 g/dose unitized doses. In some embodiments, the dispenser may provide from about 3 to about 12 unitized doses. In some embodiments, the dispenser may be refilled with additional composition.

As used herein, "composition" refers to any solid, gel, and/or paste substance having more than one component.

As used herein, "self-adhering" or "self-adhesive" refers to the ability of a composition to stick onto a hard surface without the need for a separate adhesive or other support device. In one embodiment, a self-adhering composition does not leave any residue or other substance (i.e., additional adhesive) once the composition is used up.

As used herein, "gel" refers to a disordered solid composed of a liquid with a network of interacting particles or polymers which has a non-zero yield stress.

As used herein, "fragrance" refers to any perfume, odor-eliminator, odor masking agent, the like, and combinations thereof. In some embodiments, a fragrance is any substance which may have an effect on a consumer, or user's, olfactory senses.

As used herein, "wt. %" refers to the weight percentage of an ingredient in the total formula. For example, an off-the-shelf commercial composition of Formula X may only contain 70% active ingredient X. Thus, 10 g of the off-the-shelf composition only contains 7 g of X. If 10 g of the off-the-shelf composition is added to 90 g of other ingredients, the wt. % of X in the final formula is thus only 7%.

As used herein, "hard surface" refers to any porous and/or non-porous surface. In one embodiment, a hard surface may be selected from the group consisting of: ceramic, glass, metal, polymer, stone, and combinations thereof. For the purposes of this application, a hard surface does not include silicon wafers and/or other semiconductor substrate materials. Nonlimiting examples of ceramic surfaces include: toilet bowl, sink, shower, tile, the like, and combinations thereof. A non-limiting example of a glass surfaces includes: window and the like. Nonlimiting examples of metal surfaces include: drain pipe, sink, the like. Nonlimiting examples of a polymeric surface includes: PVC piping, fiberglass, acrylic, Corian®, the like. A non-limiting example of a stone hard surface includes: granite, marble, and the like.

A hard surface may be any shape, size, or have any orientation that is suitable for its desired purpose. In one non-limiting example, a hard surface may be oriented in a vertical configuration. In another non-limiting example, a hard surface may be the surface of a curved surface, such as a ceramic toilet bowl. In yet another non-limiting example, a hard surface may be the inside of a pipe, which has vertical and horizontal elements, and also may have curved elements. It is thought that the shape, size and/or orientation of the hard surface will not affect the compositions of the present invention, because of the unexpectedly strong transport properties of the compositions under the conditions described infra.

As used herein, "surfactant" refers to any agent that lowers the surface tension of a liquid, for example water. Exemplary surfactants which may be suitable for use with the present invention are described infra. In one embodiment, surfactants may be selected from the group consisting of anionic, non-ionic, cationic, amphoteric, zwitterionic, and combinations thereof.

As used herein, "gel melt temperature" ("gel point") refers to the temperature at which the rigid gel composition abruptly transitions to a low viscosity flowable fluid having a viscosity of less than 5 Pa as the temperature of the gel is raised. To measure the gel melt temperature as defined herein a Brookfield temperature controlled Cone/Plate Viscometer (Brookfield Engineering Laboratories, Inc., Middleboro, Mass.) was used according to the manufacturer's specifications. The specific parameters used on the device are: Constant shear rate of 1/sec; C-25-1 Cone; 20° C. to 80° C. temperature ramp-up over 240 seconds.

As used herein, "gel hardness" refers to the hardness strength of a composition. The gel hardness values are determined by measurement at 22° C. using a Brookfield LFRA 1500 Texture Analyzer with TA41 probe (6 mm cylinder diameter, 35 mm length) with a trigger of 5.0 g, penetration distance of 3.0 mm, and a speed of 0.5 mm/sec, recorded as peak load values. In some embodiments, the present compositions may have a gel hardness of at least about 150 g. The compositions may have a gel hardness of at least about 175 g or at least about 185 g. The compositions may have a gel hardness of at least about 200 g. The compositions may have a gel hardness of at least about 250 g. In some embodiments, the gel hardness may range from about 150 g to 300 g. The gel hardness may range from about 175 g to 275 g or more commonly from about 185 g to 265 g. In some embodiments, the gel hardness may range from about 200 g to 250 g.

An assessment of the hardness of a gel can also be made using a Precision Penetrometer, manufactured by Precision Scientific, Co. equipped with a large diameter cone weighing 102.4 grams with a 23D angle and loaded with 150 grams of weigh on the top of a spindle. The hardness is determined by measuring the penetration of the cone into the surface of a polymer or gel solid. Samples must be at least ¼ inch thick to be used with the setup parameters. The measurement is characterized in tenths of a mm penetration into the surface of the solid or gel.

As used herein, "viscosity" refers to the resistance to gradual deformation by shear stress or tensile stress of a composition. The viscosity is measured at 25° C. using a TA AR 2000 rheometer equipped with a 4 cm stainless steel parallel plate and Peltier plate at a shear of 1 reciprocal second.

As used herein, "Force to Actuate" (FTA) refers to the force needed to dispense one dose of sample, i.e., the force required to actuate the product or force to push a dose of the product out of a dispensing device. FTA is measured using an IMADA force gauge, model MF-20, at 25° C. sample temperature. The force gauge is used to dispense one dose of sample. FTA should desirably be about 7-14 pounds of pressure. The dose weight is between 6-8 g with an average weight of dose of approximately 6.6 g.

As used herein, "adhesion" refers to the ability of a dose of gel to remain adhered on a vertical board with a tile surface. "Adhesion time" and "adhesion (in %)" may be measured according to the following protocol. A board containing twelve 4.25"×4.25" standard grade glossy ceramic tiles arranged in a 3 (in the y-direction) by 4 (in the x-direction) configuration bonded and grouted to a plexiglass back is provided. Before each determination, the board is rinsed with warm (about 75 to a 85° F.) tap water using a cellulose sponge. The board is then re-rinsed thoroughly with warm tap water. A non-linting cloth saturated with isopropanol is then used to wipe down the entire tile board. The board is placed in a horizontal position (i.e., such that the plane of the board is flat on the floor or lab bench). A force gauge is used to dispense doses of gel on the board. Samples approximately 1.5" in diameter and weighing from about 5.5 g to about 8.0 g are provided to the surface of the board such that the bottom of the dispensed sample of gel touches the top-most, horizontally oriented (i.e., in the x-direction), grout line of the board. Samples are placed approximately 2" spaced apart from each other. A permanent marker is used to draw a straight line (parallel to the x-direction) approximately 0.75" below the top-most grout line. The board is then placed in a vertical position (i.e., such that the plane of the board is perpendicular with the floor or lab bench) in an environmental chamber. The chamber is maintained at a temperature of about 86 to a 90° F. and relative humidity of about 40% to 60%. High and low temperature and humidity is recorded for a determination. The position of gels are checked every 24 hours until all samples have crossed the "fail line" or after specified time has elapsed. A camera is used to record pictures of the samples at time zero and at successive times. The time required for each sample to slide down the tile a distance of 1.5 times the diameter of the sample (circa 2.25") is determined and recorded as the "adhesion time." The reported "adhesion time" is an average determined from the values measured samples deposited on three boards. The "adhesion" reported in percentage for a particular sample is the difference above or below the value determined for a control sample.

EXAMPLES

The following examples are intended to more specifically illustrate the present cleaning compositions according to various embodiments described above. These examples should in no way be construed as limiting the scope of the present technology.

Several exemplary formulations of the cleaning compositions were prepared and are presented in Table 1 below. Table 2 presents several properties of the exemplary formulations including gel hardness, gel melt temperature, viscosity, adhesion, and adhesion time.

TABLE 1

| Run # | Type GB Surfactant | GB Surf (wt. %) | Glycerin | PEG6000 | Mineral oil | Genapol T 250 | Imbentin AG/618G | Imbentin AG168S/300 SP |
|---|---|---|---|---|---|---|---|---|
| Lab Standard | SLES | 16 | 5 | 1 | 0.5 | 0 | 15 | 12 |
| Marine | SLES | 16 | 5 | 1 | 0.9 | 0 | 15 | 12 |
| Aqua Pulse | SLES | 16 | 5 | 1 | 0.9 | 0 | 15 | 12 |
| 4D1 | C12/C14 ester crude | 12 | 0 | 0.6 | 0 | 0 | 15 | 12 |
| 5D1 | C12/C14 ester crude | 12 | 0 | 0.6 | 0 | 0 | 15 | 12 |
| 7D1 | C12/C14 ester crude | 16 | 0 | 0.6 | 0 | 0 | 15 | 12 |
| 11D2 | C12/C14 ester crude | 16 | 6 | 0.6 | 0.6 | 0 | 15 | 12 |
| 14D2 | C12/C14 ester crude | 16 | 6 | 1.2 | 0 | 0 | 15 | 12 |
| 17D2 | C12/C14 ester crude | 12 | 0 | 1.2 | 0.6 | 0 | 15 | 12 |
| 17A1D2 | C12/C14 ester crude | | | | | 0 | | |
| 17A2D2 | C12/C14 ester crude | | | | | 0 | | |
| 20D2 | C12/C14 ester crude | 12 | 6 | 1.2 | 0.6 | 0 | 15 | 12 |
| 2D3 | C12/C14 ester crude | 6 | 0 | 0.6 | 0 | 0 | 15 | 6 |
| 9D3 | C12/C14 ester crude | 6 | 0 | 0.6 | 0 | 0 | 7.5 | 12 |
| 16D3 | C12/C14 ester crude | 2 | 0 | 1.2 | 0 | 0 | 15 | 12 |
| 17D3 | C12/C14 ester crude | 2 | 0 | 0 | 0 | 0 | 15 | 12 |
| 23D3 | C12/C14 ester crude | 10 | 0 | 1.2 | 0 | 0 | 15 | 12 |
| 28D3 | C12/C14 ester crude | 10 | 0 | 0 | 0 | 0 | 15 | 12 |
| 2D4 | C12/C14 ester pure | 6 | 0 | 0.6 | 0 | 0 | 15 | 6 |
| 9D4 | C12/C14 ester pure | 6 | 0 | 0.6 | 0 | 0 | 7.5 | 12 |
| 23D4 | C12/C14 ester pure | 10 | 0 | 1.2 | 0 | 0 | 15 | 12 |
| 1D6 | C12/C14 ester crude | 16 | 0 | 0.6 | 0 | 0 | 15 | 12 |
| 2D6 | C12/C14 ester crude | 20 | 0 | 0.6 | 0 | 0 | 7.5 | 12 |
| 3D6 | C12/C14 ester crude | 12 | 0 | 1.2 | 0 | 0 | 7.5 | 12 |
| 4D6 | C12/C14 ester crude | 16 | 0 | 1.2 | 0 | 0 | 7.5 | 12 |
| 5D6 | C12/C14 ester crude | 20 | 0 | 1.2 | 0 | 0 | 7.5 | 12 |
| 6D6 | C12/C14 ester pure | 16 | 0 | 0.6 | 0 | 0 | 7.5 | 12 |
| 7D6 | C12/C14 ester pure | 20 | 0 | 0.6 | 0 | 0 | 7.5 | 12 |
| 8D6 | C12/C14 ester pure | 12 | 0 | 1.2 | 0 | 0 | 7.5 | 12 |

TABLE 1-continued

| Run # | Type GB Surfactant | GB Surf (wt. %) | Glycerin | PEG6000 | Mineral oil | Genapol T 250 | Imbentin AG/618G | Imbentin AG168S/300 SP |
|---|---|---|---|---|---|---|---|---|
| 9D6 | C12/C14 ester pure | 16 | 0 | 1.2 | 0 | 0 | 7.5 | 12 |
| 10D6 | C12/C14 ester pure | 12 | 0 | 1.2 | 0 | 0 | 7.5 | 12 |
| 11D6 | C12/C14 ester pure | 16 | 0 | 1.2 | 0 | 0 | 7.5 | 12 |
| 12D6 | C12/C14 ester pure | 6 | 0 | 1.2 | 0 | 0 | 7.5 | 12 |
| 13D6 | C12/C14 ester pure | 6 | 0 | 1.2 | 0 | 0 | 7.5 | 12 |
| 14D6 | C12/C14 ester pure | 16 | 0 | 1.2 | 0 | 0 | 7.5 | 12 |
| 15D6 | C12/C14 ester pure | 12 | 0 | 1.2 | 0 | 0 | 7.5 | 12 |
| 16D6 | C12/C14 ester pure | 6 | 0 | 1.2 | 0 | 0 | 7.5 | 12 |
| 17D6 | C12/C14 ester pure | 12 | 0 | 1.2 | 0 | 0 | 7.5 | 12 |
| 18D6 | C12/C14 ester pure | 6 | 0 | 1.2 | 0 | 0 | 7.5 | 12 |
| 19D6 | C12/C14 ester crude | 2.5 | 0 | 0 | 0 | 29.5 | 0 | 0 |
| 1D7 | C12/C14 ester crude | 2.5 | 0 | 0 | 0 | 20 | 0 | 0 |
| 2D7 | C12/C14 ester crude | 2.5 | 0 | 0 | 0 | 25 | 0 | 0 |
| 3D7 | C12/C14 ester pure | 6 | 0 | 0.6 | 0 | 0 | 7.5 | 12 |

TABLE 2

| $\gamma_{CMC}$ dyne/cm | CMC mg/l | $C_{20}$ mg/l | $\delta\gamma/\delta C$ | Maragoni Velocity | Adhesion (%) | Adhesion Times Hours | FTA | pH | Gel Point ° C. | Viscosity cP ($\times 10^3$) | Run # |
|---|---|---|---|---|---|---|---|---|---|---|---|
| | | | | 47 | — | 11.5 | 10.4 | 5.36 | 56.0 | 333.9 | Lab Standard |
| | | | | 49.5 | — | 11.3 | | | 63.5 | 447.9 | Marine |
| 44.806 | 10 | 5.45 | 1.10651 | 49.7 | — | 15.5 | 13.9 | | 64.9 | 355.2 | Aqua Pulse |
| | | | | — | 55.00% | 20.7 | 13.1 | 2.44 | 65.4 | 275.3 | 4D1 |
| 41.9 | 7.45 | 3.25 | −2.412 | 69.7 | 34.18% | 17.7 | 11.3 | 2.40 | 61.6 | 266.5 | 5D1 |
| | | | | | 38.75% | 18.5 | 12.0 | 2.35 | 60.5 | 274.2 | 7D1 |
| | | | | 79.35 | 10.87% | 14.2 | 11.1 | 2.34 | 64.8 | 211.2 | 11D2 |
| | | | | 70.75 | 9.34% | 13.3 | 9.1 | 2.36 | 64.5 | 269.4 | 14D2 |
| 40.56 | 7 | 1.74 | −0.92 | 53.6 | 79.24% | 23.5 | 11.4 | | 62.5 | 351.6 | 17D2 |
| 42.77 | 7.33 | 2.95 | −1.13 | 136.6 | | | | | | | 17A1D2 |
| 39.53 | 11.25 | 4.23 | −1.28 | 106 | | | | | | | 17A2D2 |
| | | | | 91.2 | 44.92% | 19.0 | 11.4 | | 57.5 | 323.5 | 20D2 |
| 44.258 | 11.25 | 8 | −0.838 | 65.7 | 225.42% | 48.0 | 9.2 | 2.21 | 68.3 | 214.1 | 2D3 |
| 40.76 | 9.8 | 4.1 | −0.893 | 71 | 166.67% | 39.3 | 7.8 | 2.18 | 67.4 | 155.1 | 9D3 |
| 41.55 | 15 | 5.05 | −1.315 | 92.7 | 550.70% | 92.4 | 12.2 | 2.62 | 74.6 | 350.6 | 16D3 |
| 41.06 | 18.75 | 7.02 | −1.255 | 99.7 | 550.70% | 92.4 | 10.7 | 2.71 | 80.0 | 208.5 | 17D3 |
| 38.54 | 8 | 3.1 | −2.451 | 80.9 | 550.70% | 92.4 | 14.1 | 1.94 | 67.0 | 338.1 | 23D3 |
| 41.06 | 9 | 5.62 | −2.033 | 78.3 | 263.64% | 34.8 | 15.8 | 1.76 | 78.3 | 364.8 | 28D3 |
| 37.86 | 6.9 | 3 | −3.9576 | 126.2 | 238.97% | 48.0 | 8.0 | 4.40 | 66.7 | 214.5 | 2D4 |
| 44.48 | 14 | 9 | .58598 | 71.9 | −12.25% | 13.8 | 8.3 | 4.90 | 61.9 | 236.4 | 9D4 |
| 40.79 | 6.25 | 3.8 | .16939 | 116 | −84.56% | 4.0 | 13.5 | 4.50 | 68.4 | 597.0 | 23D4 |
| | | | | | −18.46% | 13.3 | 11.1 | | 74.7 | 332.1 | 1D6 |
| | | | | | −36.41% | 10.3 | 9.8 | | 42 | 239.8 | 2D6 |
| | | | | | −44.19% | 8.0 | 8.2 | | 55.7 | 214.3 | 3D6 |
| | | | | | −56.92% | 7.0 | 10 | | 51 | 237.1 | 4D6 |
| | | | | | −47.67% | 7.5 | 10.6 | | 42.3 | 238.9 | 5D6 |
| | | | | | −85.64% | 2.3 | 14.2 | | 48.2 | 529.6 | 6D6 |
| | | | | | −91.79% | 1.3 | 14.3 | | 37.7 | 438.9 | 7D6 |
| | | | | | −83.72% | 2.3 | 8.8 | | 44.9 | 420.9 | 8D6 |
| | | | | | −93.02% | 1.0 | 8.4 | | 25.6 | 154.4 | 9D6 |
| | | | | | −56.75% | 9.0 | 10.4 | | 43.4 | 411.5 | 10D6 |
| | | | | | −93.85% | 1.0 | 8.5 | | 31.4 | 376.1 | 11D6 |
| | | | | | −21.94% | 12.3 | 7.4 | | 62.4 | 190.9 | 12D6 |
| | | | | | −84.78% | 2.3 | 6.6 | | 58.6 | 145.1 | 13D6 |
| | | | | | −95.65% | 0.7 | 12.2 | | 35.6 | 204.3 | 14D6 |
| | | | | | −96.28% | 0.5 | 7.2 | | 41.4 | 241.2 | 15D6 |

TABLE 2-continued

| $\gamma_{CMC}$ dyne/cm | CMC mg/l | $C_{20}$ mg/l | δγ/δC | Maragoni Velocity | Adhesion (%) | Adhesion Times Hours | FTA | pH | Gel Point ° C. | Viscosity cP (×10³) | Run # |
|---|---|---|---|---|---|---|---|---|---|---|---|
| | | | | | −68.60% | 4.5 | 6.8 | | 56.3 | 124.4 | 16D6 |
| | | | | | −69.41% | 4.8 | 8.3 | | 43.4 | 381.5 | 17D6 |
| | | | | | −9.28% | 14.3 | 7 | | 62.5 | 205.9 | 18D6 |
| | | | | | 48 | 48.0 | 13.5 | | 73.6 | 510.6 | 19D6 |
| 42.31 | 10.75 | 6.95 | 2.27856 | | −0.6087 | 6 | 10.8 | | 68.4 | 315.6 | 1D7 |
| 43.04 | 8.25 | 4.5 | −1.93 | | 0.0109 | 15.5 | 7.6 | | 65.4 | 169.16 | 2D7 |
| 40.59 | 5 | 1.55 | −4.2437 | | 0.4837 | 22.8 | 10 | | 67.7 | 204.2 | 3D7 |
| $\gamma_{CMC}$ | CMC | $C_{20}$ | δγ/δC | Maragoni Velocity | Adhesion (%) | Adhesion Times | FTA | pH | Gel Point | Viscosity (cP × 10³) | Run # |

The composition of a number of additional exemplary glycine betaine esters which may be used in formulations of the present cleaning compositions are presented in Table 3 below.

TABLE 3

Exemplary Crude GB Ester derivatives

| | Compositions | | | |
|---|---|---|---|---|
| | GB ester* Wt. % | Alcohol** Wt. % | MSA*** Wt. % | GB*+ Wt. % |
| GB caprylic (C8) ester | 60.4 | 5.9 | 31.1 | 2.5 |
| Caprylic/capric (C8/C10) ester | 60.7 | 6.1 | 30.3 | 2.9 |
| Lauric/myristic (C12/C14) ester | 62.3 | 7.9 | 27.6 | 2.2 |

*As methanesulfonate salt
**Alcohol corresponding to ester group
***Methanesulfonate acid
*+GB = glycine betaine

Illustrative Embodiments

Reference is made in the following to a number of illustrative embodiments of the subject matter described herein. The following embodiments describe illustrative embodiments that may include various features, characteristics, and advantages of the subject matter as presently described. Accordingly, the following embodiments should not be considered as being comprehensive of all of the possible embodiments or otherwise limit the scope of the methods, materials and compositions described herein.

In one aspect, the present technology provides a composition for treating a hard surface including (a) an adhesion promoter, which includes at least one compound including one or more polyalkoxy groups; (b) a glycine betaine ester of formula (I):

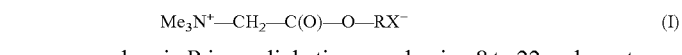

$$Me_3N^+—CH_2—C(O)—O—RX^- \quad (I)$$

wherein R is an aliphatic group having 8 to 22 carbon atoms; and $X^-$ represents an inorganic or organic anion; and (c) water; wherein the composition is self-adhering upon application to a hard surface. In some embodiments, the X— may represent a methanesulfonate anion. In some embodiments, the composition may be a gel having a gel melt temperature of about 55-80° C. The composition may be a gel having a viscosity at 25° C. of at least about 150,000 cP. In some embodiments, the composition may be a gel having a hardness of at least about 150 g. In some embodiments, the composition may be a gel having a hardness of at least about 150 g, a gel melt temperature of about 55-80° C., and a viscosity at 25° C. of at least about 400,000 cP.

In some embodiments, the adhesion promoter may include an ethoxylated alcohol. In some embodiments, the adhesion promoter may include an ethoxylated $C_{12}$-$C_{30}$ aliphatic alcohol having an average of about 15 to 100 ethylene oxide units. In some embodiments, the adhesion promoter may include an ethoxylated linear $C_{14}$-$C_{22}$ primary aliphatic alcohol having an average of about 20-35 ethylene oxide units. The composition may include about 20-35 wt. % of an ethoxylated $C_{14}$-$C_{22}$ fatty alcohol having an average of about 20-35 ethylene oxide units. In some embodiments, the adhesion promoter may include an ethoxylated $C_{14}$-$C_{22}$ fatty alcohol. In some embodiments, the adhesion promoter may include an ethyleneoxide-propyleneoxide block copolymer. The ethyleneoxide-propyleneoxide block copolymer may include an EO-PO block copolymer, an EO-PO-EO block copolymer, a $C_8$-$C_{18}$ alcohol EO-PO adduct, a $C_8$-$C_{18}$ alcohol PO-EO adduct, and/or an EO-PO dialkyl ether. In some embodiments, the adhesion promoter may include polyethylene glycol. In some embodiments, the adhesion promoter may further include polysaccharide and/or synthetic polymer resin.

The composition may further include one or more of mineral oil, polyol humectant, an antimicrobial agent, and a fragrance component. In some embodiments, the composition may further include a surfactant selected from nonionic, anionic, cationic, zwitterionic, and/or amphoteric surfactants and mixtures thereof; wherein the surfactant is different from the adhesion promoter. The nonionic surfactant may include an alkylpolyglycoside and/or an ethoxylated $C_8$-$C_{15}$ alcohol having an average of 5 to 12 ethylene oxide units.

In some embodiments, the composition may include: (a) about 0.1-5 wt. % of the glycine betaine ester; (b) about 15-40 wt. % of the adhesion promoter; (c) about 0.1-5 wt. % polyethylene glycol; (d) about 1-10 wt. % polyol humectant; (e) about 1-10 wt. % of a fragrance component; and (f) at least about 25 wt. % water. In some embodiments, the composition may include: (a) about 0.1-5 wt. % of the glycine betaine ester; (b) about 20-35 wt. % of the adhesion promoter; (c) about 0.5-2 wt. % polyethylene glycol; (d) about 1-10 wt. % glycerin; (e) about 1-10 wt. % of a fragrance component; and (f) at least about 25 wt. % water. In some embodiments, the composition may include: (a) about 15-35 wt. % of the adhesion promoter, which includes an ethoxylated $C_{14}$-$C_{22}$ fatty alcohol having an average of about 15-40 ethylene oxide units; (b) about 0.1-5 wt. % of the glycine betaine ester; (c) about 1-10 wt. % ethyleneoxide-propyleneoxide block copolymer; (d) about 1-10 wt. % glycerin; (e) about 0.1-3 wt. % mineral oil; (f) 0 to about 10 wt. % of a fragrance component; and (g) at least about 40 wt. % water. In some embodiments, the composition may include: (a) about 15-35 wt. % of the adhesion promoter, which includes an ethoxylated $C_{14}$-$C_{22}$ fatty alcohol having an average of about 15-40 ethylene oxide units; (b) about 0.1-5 wt. % of the glycine betaine ester; (c) about 0.5-5 wt. % of one or more ethoxylated linear primary alcohols, wherein each alcohol includes a carbon chain containing 9 to 15 carbons and from 2 to 12 ethylene oxide units; (d) about 1-10 wt. % glycerin; (e) 0 to about 3 wt. % mineral oil; (f) 0 to about 5 wt. % polyethylene glycol; (g) 0 to about 10 wt. % of a fragrance component; and (h) at least about 40 wt. % water. In some embodiments, the composition may include: (a) about 15-35 wt. % of the adhesion promoter, which includes an ethoxylated $C_{14}$-$C_{22}$ fatty alcohol having an average of about 15-40 ethylene oxide units; (b) about 0.1-5 wt. % of the glycine betaine ester; (c) about 0.1-3 wt. % mineral oil; (d) about 1-10 wt. % glycerin; (e) about 0.1-5 wt. % polyethylene glycol; (f) 0 to about 3 wt. % of one or more linear primary alcohols, wherein each alcohol includes a carbon chain containing 9 to 15 carbons; (g) 0 to about 10 wt. % of a fragrance component; and (h) at least about 40 wt. % water.

In some embodiments, the R group of Formula I may be a $C_8$, $C_{10}$, $C_{12}$, $C_{14}$, $C_{16}$ and/or $C_{18}$ alkyl group and/or an oleic group. The R group of Formula I may be a lauric, myristic, palmitic, stearic and/or oleic group. In some embodiments, the glycine betaine ester may include a mixture of glycine betaine esters having R groups with 12 carbon atoms and 14 carbon atoms; and the composition may further include a mixture of alcohols (ROH) having R groups with 12 carbon atoms and 14 carbon atoms. In some embodiments, $X^-$ represents a methanesulfonate anion. The composition may further include a glycine betaine amide of formula (II):

$$Me_3N^+—CH_2—C(O)—NH—RX^- \quad (II)$$

wherein R is an aliphatic group having 8 to 22 carbon atoms; and $X^-$ represents an inorganic or organic anion. In some embodiments, the $X^-$ may represent a methanesulfonate anion; the R group may include a lauric and/or myristic group; and the adhesion promoter may include an ethoxylated linear $C_{14}$-$C_{22}$ primary aliphatic alcohol having an average of about 15 to 40 ethylene oxide units. The composition may be a gel and have a gel melt temperature of about 60-70° C. and a viscosity at 25° C. of about 250,000 to 600,000 cP.

In one aspect, the present technology provides a composition for treating a hard surface that may include (a) at least one adhesion promoter, which includes at least one polyalkoxy group; (b) a glycine betaine ester of formula (I):

$$Me_3N^+—CH_2—C(O)—O—RX^- \quad (I)$$

wherein R is an aliphatic group having 8 to 22 carbon atoms; and (c) water; wherein the composition may be a gel having a gel melt temperature of about 55-80° C. and a viscosity at 25° C. of at least about 150,000 cP. In some embodiments, the gel may have a viscosity at 25° C. of about 250,000 to 500,000 cP. The composition may be self-adhering upon application to a hard surface.

In another aspect is provided a composition for treating a hard surface that includes (a) at least one adhesion promoter, which includes at least one polyalkoxy group; (b) a glycine betaine ester of formula (I):

$$Me_3N^+—CH_2—C(O)—O—RX^- \quad (I)$$

wherein R is an aliphatic group having 8 to 22 carbon atoms; and (c) water; wherein the composition may be a gel having a hardness of at least about 150 g and a gel melt temperature of about 55-80° C. In some embodiments, the gel may have a viscosity at 25° C. of about 500,000 cP. The composition may be self-adhering upon application to a hard surface.

In one aspect is provided a composition for treating a hard surface that includes (a) at least one adhesion promoter, which includes an organic molecule including a polyalkoxy group; (b) at least one surfactant selected from the group consisting of: anionic, nonionic, cationic, amphoteric, zwitterionic, and combinations thereof; (c) the glycine betaine ester; (d) a blend of ethoxylated linear primary alcohols, wherein each alcohol of the blend includes a carbon chain containing 9 to 17 carbons; (e) at least one solvent, which includes glycerin; (f) a polyol humectant, such as mineral oil; and (g) water; where the composition is self-adhering upon application to a vertical hard surface. In some embodiments, the at least one adhesion promoter may further include a hydrophilic polymer. In some embodiments, the at least one surfactant may further include at least one cationic surfactant. In some embodiments, the at least one adhesion promoter may further include a polysaccharide. The composition may further include an active agent, wherein the active agent is one or more of a fragrance, germicide, antimicrobial, bleach, or deodorizer.

In some embodiments, the present composition includes the glycine betaine ester and may include about 0.5 to 3.5 wt. % of the mineral oil; about 1 to 12 wt. % glycerin; and about 18 to 27 wt. % of the at least one ethoxylated alcohol. In some embodiments, the composition may include about 18 to 27 wt. % of an ethoxylated alcohol; about 0.5 to 3.5 wt. % of the mineral oil; and about 5 to 10 wt. % glycerin; 0 to about 6 wt. % of a fragrance; and at least about 40 wt. % water. The at least one nonionic surfactant may include a $C_{16}$-$C_{18}$ ethoxylated alcohol including about 15 to 40 ethoxy groups.

In another aspect is provided a composition for treating a hard surface that includes: (a) about 18 to 27 wt. % of at least one adhesion promoter; wherein the at least one adhesion promoter includes an organic molecule with a hydrophilic residual and a hydrophobic residual; (b) the glycine betaine amide; (c) at least one surfactant selected from the group consisting of: anionic, nonionic, cationic, amphoteric, zwitterionic, and combinations thereof; wherein the at least one surfactant includes at least about 7.5 wt. % based on the total weight of the composition of at least one nonionic surfactant, which can serve all or in part as the at least one adhesion promoter; (d) from greater than 0 to about 5 wt. % mineral oil; (e) at least about 25 wt. % water; (f) 0 to about 2.0 wt. % of a blend of linear primary alcohols, wherein each alcohol of the blend includes a carbon chain containing 9 to 17 carbons; and (g) optionally, at least one solvent; wherein the composition is self-adhering upon application to a vertical hard surface.

In one aspect is provided a self-adhesive composition that includes (a) at least one adhesion promoter; (b) a glycine betaine ester of formula (I):

$$Me_3N^+—CH_2—C(O)—O—RX^- \quad (I)$$

wherein R is an aliphatic group having 8 to 22 carbon atoms and $X^-$ is an organic or inorganic anion; and (c) water. In some embodiments, R, is an alkyl and/or alkenyl group. In some embodiments, R may be $C_{10}$-$C_{18}$ aliphatic group. In some embodiments, R may be a $C_8$, $C_{10}$, $C_{12}$, $C_{14}$, $C_{16}$, and/or $C_{18}$ aliphatic group. In some embodiments, R may be a lauric, mystric, and/or oleic group. In some embodiments, R may be a $C_{12}$ and/or $C_{14}$ alkyl or alkenyl group. $X^-$ may be a methane sulfonate anion. In some embodiments, the composition may further include ROH and/or salt thereof, wherein R is as defined herein. In some embodiments, the composition may further include ROH and/or salt thereof, wherein R is an aliphatic $C_8$-$C_{18}$ alcohol. The composition may further include methanesulfonic acid and/or salt thereof. In some embodiments, the adhesion promoter may be an alkoxylated alcohol. The alkoxylated alcohol may include one or more ethoxylated alcohols. In some embodiments, the one or more ethoxylated alcohols may include an ethoxylated $C_{12}$-$C_{30}$ alcohol having an average of 15 to 50 ethylene oxide units. In some embodiments, the adhesion promoter may further include a polysaccharide.

While certain embodiments have been illustrated and described, it should be understood that changes and modifications can be made therein in accordance with ordinary skill in the art without departing from the technology in its broader aspects.

The embodiments, illustratively described herein may suitably be practiced in the absence of any element or elements, limitation or limitations, not specifically disclosed herein. Thus, for example, the terms "comprising," "including," "containing," shall be read expansively and without limitation. Additionally, the terms and expressions employed herein have been used as terms of description and not of limitation, and there is no intention in the use of such terms and expressions of excluding any equivalents of the features shown and described or portions thereof, but it is recognized that various modifications are possible within the scope of the claimed technology. Additionally, the phrase "consisting essentially of" will be understood to include those elements specifically recited and those additional elements that do not materially affect the basic and novel characteristics of the claimed technology. The phrase "consisting of" excludes any element not specified.

As used herein, "about" will be understood by persons of ordinary skill in the art and will vary to some extent depending upon the context in which it is used. If there are uses of the term which are not clear to persons of ordinary skill in the art, given the context in which it is used, "about" will mean up to plus or minus 10% of the particular term.

The use of the terms "a" and "an" and "the" and similar referents in the context of describing the elements (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the embodiments and does not pose a limitation on the scope of the claims unless otherwise stated. No language in the specification should be construed as indicating any non-claimed element as essential.

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, particularly in terms of providing a written description, all ranges disclosed herein also encompass any and all possible subranges and combinations of subranges thereof.

What is claimed is:

1. A composition for treating a hard surface comprising:
(a) an adhesion promoter, which comprises:
i) an ethoxylated $C_{12}$-$C_{30}$ aliphatic alcohol having an average of about 15 to 100 ethylene oxide units;
ii) an ethyleneoxide-propyleneoxide block copolymer;
(b) a glycine betaine ester of formula (I):

$$Me_3N^+—CH_2—C(O)—O—RX^- \quad (I)$$

wherein R is an aliphatic group having 8 to 22 carbon atoms; and $X^-$ represents an inorganic or organic anion; and
(c) one or more ethoxylated alcohols, wherein each alcohol includes a carbon chain containing 8 to 15 carbons and from 2 to 12 ethylene oxide units; and
(d) water;
wherein the composition is self-adhering upon application to a hard surface.

2. The composition of claim 1 wherein the composition is a gel having a gel melt temperature of about 55-80° C.

3. The composition of claim 1, wherein the composition is a gel having a viscosity at 25° C. of at least about 150,000 cP.

4. The composition of claim 1, wherein the composition is a gel having a gel hardness of at least about 150 g.

5. The composition of claim 1, wherein the composition comprises about 20-35 wt. % of an ethoxylated $C_{14}$-$C_{22}$ fatty alcohol having an average of about 20-35 ethylene oxide units.

6. The composition of claim 1, wherein the adhesion promoter further comprises polyethylene glycol.

7. The composition of claim 1, further comprising one or more of mineral oil, polyol humectant, an antimicrobial agent, and a fragrance component.

8. The composition of claim 1, wherein the adhesion promoter further comprises polysaccharide and/or synthetic polymer resin.

9. The composition of claim 1, further comprising a surfactant selected from the group consisting of nonionic, anionic, cationic, zwitterionic and/or amphoteric surfactants and mixtures thereof; wherein the surfactant is different from the adhesion promoter.

10. The composition of claim 9, wherein the nonionic surfactant comprises an alkylpolyglycoside and/or an ethoxylated $C_8$-$C_{15}$ alcohol having an average of 5 to 12 ethylene oxide units.

11. The composition of claim 1, comprising:
(a) about 0.1-5 wt. % of the glycine betaine ester;
(b) about 15-40 wt. % of the adhesion promoter;
(c) at least about 25 wt. % water; and further comprises;
(d) about 0.1-5 wt. % polyethylene glycol;
(e) about 1-10 wt. % polyol humectant; and
(f) about 1-10 wt. % of a fragrance component.

12. The composition of claim 1, comprising:
(a) about 15-35 wt. % of the adhesion promoter, which comprises an ethoxylated $C_{14}$-$C_{22}$ fatty alcohol having an average of about 15-40 ethylene oxide units;
(b) about 0.1-5 wt. % of the glycine betaine ester;
(c) about 1-10% of the ethyleneoxide-propyleneoxide copolymer;
(d) at least about 40 wt. % water; and further comprises;
(e) about 1-10 wt. % glycerin;
(f) about 0.1-3 wt. % mineral oil; and
(g) 0 to about 10 wt. % of a fragrance component.

13. The composition of claim 1, comprising:
(a) about 15-35 wt. % of the adhesion promoter, which comprises an ethoxylated $C_{14}$-$C_{22}$ fatty alcohol having an average of about 15-40 ethylene oxide units;
(b) about 0.5-5 wt. % of the glycine betaine ester;
(c) about 0.5-5 wt. % one or more ethoxylated alcohols, wherein each alcohol includes a carbon chain containing 9 to 15 carbons and from 2 to 12 ethylene oxide units;
(d) at least about 40 wt. % water; and further comprises;
(e) about 1-10 wt. % glycerin;
(f) 0 to about 3 wt. % mineral oil; and
(g) 0 to about 5 wt. % polyethylene glycol; and
(h) 0 to about 10 wt. % of a fragrance component.

14. The composition of claim 1, comprising:
(a) about 15-35 wt. % of the adhesion promoter, which includes an ethoxylated $C_{11}$-C22 fatty alcohol having an average of about 15-40 ethylene oxide units;
(b) about 0.1-5 wt. % of the glycine betaine ester;
(c) at least about 40 wt. % water; and further comprises;
(d) about 0.1-3 wt. % mineral oil;
(e) about 1-10 wt. % glycerin;
(f) about 0.1-5 wt. % polyethylene glycol;
(g) greater than 0 up to about 3 wt. % of one or more linear primary alcohols, wherein each alcohol includes a carbon chain containing 9 to 15 carbons; and
(h) 0 to about 10 wt. % of a fragrance component.

15. The composition of claim 1, wherein the R group is a $C_8$, $C_{10}$, $C_{12}$, $C_{14}$, $C_{16}$ and/or $C_{18}$ alkyl group and/or an oleic group.

16. The composition of claim 15, wherein the R group is a lauric, myristic, palmitic, stearic and/or oleic group.

17. The composition of claim 15, wherein the glycine betaine ester comprises a mixture of glycine betaine esters having R groups with 12 carbon atoms and 14 carbon atoms; and the composition further comprises a mixture of alcohols (ROH) having R groups with 12 carbon atoms and 14 carbon atoms.

18. The composition of claim 15, wherein the $X^-$ represents a methanesulfonate anion.

19. The composition of claim 15, further comprising a glycine betaine amide having a formula:

$$Me_3N^+—CH_2—C(O)—NH—RX^-$$

wherein R is an aliphatic group having 8 to 22 carbon atoms; and $X^-$ represents an inorganic or organic anion.

20. The composition of claim 15, wherein the $X^-$ represents a methanesulfonate anion; the R group comprises a lauric and/or myristic group; and the adhesion promoter comprises an ethoxylated linear $C_{14}$-$C_{22}$ primary aliphatic alcohol having an average of about 15 to 40 ethylene oxide units.

21. The composition of claim 20 wherein the composition is a gel having a gel melt temperature of about 60 to 70° C.; and a viscosity at 25° C. of about 250,000 to 500,000 cP.

22. The composition of claim 15, further comprising methanesulfonic acid and/or a methanesulfonate salt.

23. The composition of claim 15, further comprising $$Me_3N^+—CH_2—CO_2^-.$$

24. A composition for treating a hard surface comprising:
(a) an adhesion promoter, which comprises:
i) an ethoxylated $C_{12}$-$C_{30}$ aliphatic alcohol having an average of about 15 to 100 ethylene oxide units;
ii) an ethyleneoxide-propyleneoxide block copolymer;
(b) a glycine betaine ester of formula (I):

$$Me_3N^+—CH_2—C(O)—O—RX^- \quad (I)$$

wherein R is an aliphatic group having 8 to 22 carbon atoms; and $X^-$ represents an inorganic or organic anion; and
(c) water;
wherein the composition is a gel having a gel melt temperature of about 55-80° C. and a viscosity at 25° C. of at least about 150,000 cP.

25. A composition for treating a hard surface comprising:
(a) at least one adhesion promoter, which comprises an ethoxylated linear $C_{14}$-$C_{22}$ primary aliphatic alcohol having an average of about 15 to 40 ethylene oxide units and an ethyleneoxide-propyleneoxide block copolymer;
(b) a glycine betaine ester of Formula I:

$$Me_3N^+—CH_2—C(O)—O—RX^- \quad (I)$$

wherein R is an aliphatic group having 8 to 22 carbon atoms; and
(c) water;
wherein the composition is a gel having a gel hardness of at least about 150 g and a gel melt temperature of about 55-80° C.

26. The composition of claim 25, wherein the adhesion promoter further comprises a hydrophilic polymer.

27. The composition of claim 25, further comprising an active agent, wherein the active agent is one or more of a fragrance, germicide, antimicrobial, bleach, or deodorizer.

28. The composition of claim 25, further comprising a film forming polymer additive.

29. The composition of claim 28 wherein the film forming polymer additive comprises a hydrophilic polyacrylate copolymer.

30. A composition for treating a hard surface comprising
(a) an adhesion promoter, which comprises an ethoxylated linear $C_{14}$-$C_{22}$ primary aliphatic alcohol having an average of about 15 to 40 ethylene oxide units and an ethyleneoxide-propyleneoxide block copolymer;
(b) a glycine betaine ester of formula (I):

$$Me_3N^+—CH_2—C(O)—O—RX^- \quad (I)$$

wherein R is an aliphatic group having 8 to 22 carbon atoms; and $X^-$ represents an inorganic or organic anion;
(c) one or more ethoxylated alcohols, wherein each alcohol includes a carbon chain containing 8 to 15 carbons and from 2 to 12 ethylene oxide units; and
(d) water;
wherein the composition is self-adhering upon application to a hard surface and has a gel melt temperature of about 55-80° C. and a viscosity at 25° C. of at least about 150,000 cP.

31. The composition of claim 30, further comprising one or more alcohols ROH, wherein the R group is as previously defined.

32. The composition of claim 30, further comprising one or more of methanesulfonic acid, a methanesulfonate salt and $Me_3N^+—CH_2—CO_2^-$.

* * * * *